United States Patent [19]

Dickson

[11] 4,066,925

[45] Jan. 3, 1978

[54] ELECTROLUMINESCENT LAMP AND ELECTRODE PREFORM FOR USE THEREWITH

[75] Inventor: Arthur D. Dickson, St. Paul, Minn.

[73] Assignee: Minnesota Mining and Manufacturing Company, St. Paul, Minn.

[21] Appl. No.: 711,356

[22] Filed: Aug. 3, 1976

[51] Int. Cl.[2] ..... H05B 33/06; H05B 33/26

[52] U.S. Cl. ..... 313/503; 313/509; 313/511; 428/209

[58] Field of Search ..... 313/511, 509, 503, 498; 427/66; 428/209; 174/117 A

[56] References Cited

U.S. PATENT DOCUMENTS

| | | | |
|---|---|---|---|
| 2,774,004 | 12/1956 | Jaffe | 313/511 X |
| 2,791,723 | 5/1957 | Nagy et al. | 313/498 X |
| 2,901,652 | 8/1959 | Fridrich | 313/509 |
| 3,393,337 | 7/1968 | Panerai et al. | 313/509 |
| 3,497,383 | 2/1970 | Olyphant, Jr. et al. | 427/123 X |

*Primary Examiner*—Palmer C. Demeo

*Attorney, Agent, or Firm*—Cruzan Alexander; Donald M. Sell; William B. Barte

[57] ABSTRACT

A flexible electroluminescent device and a preform for use therein, in which the device includes a body of electroluminescent particles in a flexible resin sandwiched between electrode layers, one of which is substantially transparent. The substantially transparent electrode is provided as a preform comprising a transparent polymeric substrate, a transparent conductive thin-film, preferably including transmission enhancing dielectric layers, a conductive film extending along the length of a narrow portion of the transparent thin-film and a contact means which also extends along the length of the conductive film.

11 Claims, 3 Drawing Figures

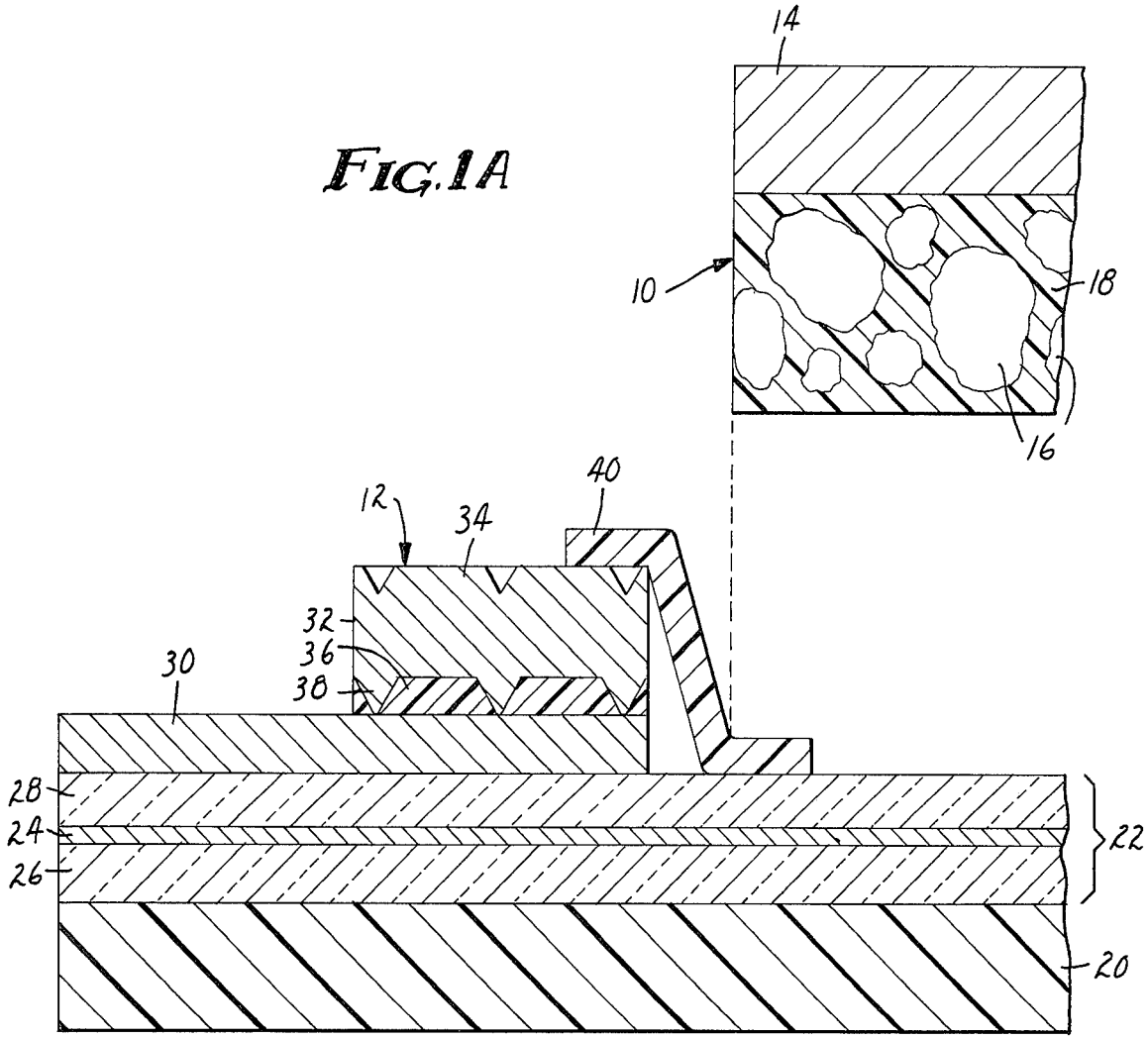
FIG. 1A
FIG. 1B
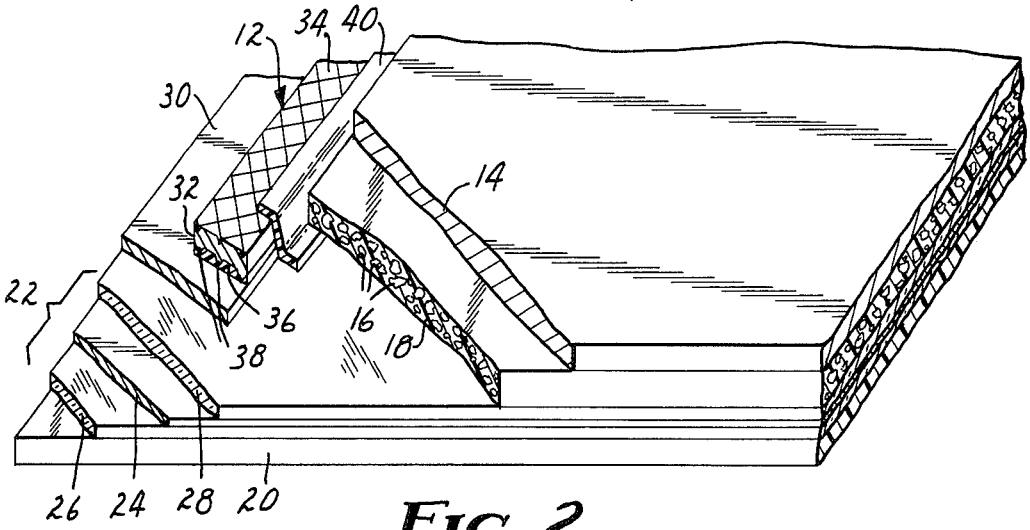
FIG. 2

ELECTROLUMINESCENT LAMP AND ELECTRODE PREFORM FOR USE THEREWITH

BACKGROUND OF THE INVENTION

1. Field of the Invention

This invention relates to improvements in electroluminescent lamps, particularly to an improved electrical contact configuration for use with flexible electroluminescent lamps.

2. Description of the Prior Art

One type of electroluminescent lamp comprises a laminate of a layer of particles of electroluminescent phosphors in an organic resinous binder sandwiched between electrode layers, one electrode layer of which is transparent to the light emitted by the phosphor. In the prior art, the transparent light emitting electrode is generally either a layer of transparent metal oxide such as tin oxide or indium oxide, or a deposit of a thin metal layer. In any event, a compromise must generally be made between the light transmissivity and the conductivity of the electrode. Until recently, this compromixe has precluded the formation of a thin-film electrode having acceptable levels of transmissivity and conductivity. However, the development of a multiple layer transparent electrode such as that disclosed in my copending patent application, Ser. No. 673,680, filed Apr. 5, 1976 overcomes such limitations. While a suitable transparent electrode is there disclosed, a reliable electrical connection thereto enabling the uniform distribution of an electrical potential across the electrode has remained a problem. In U.S. Pat. No. 3,231,664 (Acton) there is depicted an electrical contact to similar thin-film conductive layers which includes a relatively thick insulating separating layer. Such a layer is intended to apparently prevent the bond between the thin-film layer and another conductive layer from adversely affecting the properties of the first thin layer, but does not assist in providing a uniform distribution of electrical potentials. In U.S. Pat. No. 3,497,750 (Knochel and Wollentin) there is depicted a flexible electroluminescent lamp in which contacts to the transparent electrode are provided via a copper mesh electrode which is anchored directly to the transparent electrode by conductive cements or pressure contacts. Again, such structures do not solve the problem of providing reliable contact which uniformly distributes potential over the surface of the transparent electrode.

SUMMARY OF THE INVENTION

The present invention is directed to a flexible electroluminescent device and to a preform adapted for use therein. Such a device generally includes a light transmitting flexible resin body having opposing faces and finely divided electroluminescent phosphor particles embedded therein, which body is sandwiched between and bonded to electrically conductive electrode layers, one of which layers is substantially transparent. In the present invention, the substantially transparent electrode layer is provided as a substantially continuous preform in which additional elements are provided to enable the ready application and uniform distribution of an electrical potential throughout the transparent electrode layer. The preform of the present invention is further adapted to be wound upon itself in roll form. The preform includes a substantially transparent electrically conducting thin-film layer extending over one surface of a web of transparent polymeric material. A continuous electrically conductive metallic film is deposited in intimate contact with and extends the length of a narrow portion of the thin-film layer and exhibits a surface resistivity of not greater than one ohm per square. In alternative embodiments, the metallic film may be deposited on the polymeric web and the transparent thin-film layer deposited thereover or may be deposited on top of the transparent thin-film layer. An electrical contact means adhesively secured to and extending the length of the conductive layer completes the preform. An electrical potential applied to the contact means is thereby distributed through the conductive film and substantially uniformly throughout the transparent thin-film layer.

In a preferred embodiment, the substantially transparent electrically conducting thin-film layer includes a three layer sandwich of a thin-film or a metal selected from the group including gold, silver and copper between thin-film layers of dielectric materials generally exhibiting an index of refraction in excess of two. The dielectric layers inhibit light reflection from the metal thin-film and thereby increase the transmissivity of the resultant sandwich. The metal thin-film layer has an equivalent thickness in the range between 70 and 180 A and each of the thin-film dielectric layers has an equivalent thickness in the range between 400 and 600 A. These parameters provide a said three layer sandwich exhibiting a resistivity of less than 30 ohms per square and a transmissivity of not less than 70% at a wavelength of 5500 A.

Preferably, the conductive layer included in the preform includes a strip of a film of a metal selected from the group consisting of copper, silver and gold deposited onto the substantially transparent thin-film layer. The electrical contact means preferably comprises an electrically conducting adhesive tape including a flexible continuous electrically conducting metallic backing embossed with a plurality of closely spaced projections. A layer of adhesive having a thickness enabling electrical conduction between the projections to a surface onto which the tape is applied is further provided. In the electroluminescent device of the present invention, a preform such as described hereinabove is assembled together with a light transmitting flexible resin body having opposing faces a finely divided electroluminescent phosphor particles embedded therein, which body is bonded to an electrode layer such as a web of metallic foil. In such an embodiment, a layer of electrically insulating tape is adhesively secured between the exposed surface of the electrical contact means and the surface of the resin body. In such a device, the conductive film and electrical contact means ensures that an electrical potential applied to the contact means is uniformly distributed through the conductive film and throughout the transparent thin-film layer. The electrically insulating tape ensures that such a potential is insulated from the electrode layer on the opposite side of the resin body.

BRIEF DESCRIPTION OF THE DRAWING

FIGS. 1A and 1B are a cross section of one embodiment of the present invention including a preform adapted for use in forming an electroluminescent device; and FIG. 2 is a cut-away perspective view of an electroluminescent device of the present invention.

DESCRIPTION OF THE PREFERRED EMBODIMENTS

FIGS. 1A and 1B are exploded cross sectional views of one embodiment of the present invention in which a flexible electroluminescent lamp is shown to be capable of being assembled from two preforms 10 and 12 respectively. The preform 10 includes a foil of a conductive metal such as aluminum onto which is coated a dispersion of electroluminescent particles 16 in a polymeric binder 18. In a preferred embodiment of the present invention such a construction is formed from a dispersion of 30 micrometers average diameter electroluminescent particles of electroluminescent quality copper-doped zinc sulfide particles, commercially available from Sylvania Electric Products Inc. in an acrylic solvent system. Such a dispersion is knife-coated at a wet thickness approximately 150 micrometers onto a 50 micrometers thick aluminum foil substrate. The wet coating is then passed adjacent a heat source to evaporate the solvent from the dispersion, thereby forming a dried coating approximately 65 micrometers thick. Such coatings are well known to those skilled in the art and a wide variety of variations in the construction of the electrode 14 as well as in the type of phosphor particles, binders, solvents, coating systems and the like will readily be construed to be within the scope of the present invention.

The preform 12 provides the transparent conductive electrode for the resultant electroluminescent device and is subject to more critical constraints. In the present invention, the preform comprises a transparent substrate 20 onto which is deposited a substantially transparent electrode 22. The substrate 20 may be selected from a variety of transparent polymeric materials such as polyethylene terephthalate, methyl methacrylate and the like. Such substrates are selected to be optically clear and to have a relatively high degree of optical transparency. To facilitate handling during processing, such a substrate is desirably selected to be relatively thick, thereby minimizing propensities for the substrate to wrinkle or to become twisted during the processing operations. In one embodiment, a 100 micrometers thick polyethylene terephthalate substrate is preferred.

The substantially transparent electrode 22 is preferably formed of a sandwich of a metal film 24 disposed between two high index of refraction dielectric films 26 and 28. Such films are preferably deposited upon the substrate 20 by suitable evaporation processes. In a typical such process, a first dielectric layer 26 is evaporated onto the substrate 20 in an operation in which the substrate is placed in an evacuatable chamber, the chamber evacuated to pressures consistent with typical vapor coating processes, such as approximately $10^{-5}$ Torr, and a film of the selected dielectric deposited onto the substrate. In one particularly preferred embodiment a layer of zinc sulfide having an equivalent thickness of approximately 510 A was thus provided. Such a material may be evaporated from a single boat containing a charge of zinc sulfide powder. The thickness of the deposit may be continuously monitored according to conventional techniques such as with a crystal type deposition monitor or suitable electrical and optical techniques.

Following the deposition of the first dielectric layer 26, a metal thin-film layer 24 is deposited upon the dielectric thin-film layer 26. While such a thin-film may be formed of any of the highly conductive metals such as gold, silver, copper and aluminum, a particularly preferred film is formed from silver such that a highly conductive yet transparent film is obtained at a relatively low cost. In a particularly preferred embodiment, a thin-film of silver having an equivalent thickness of 120 A was deposited. Depending upon the choice of metal and the required degree of transparency and conductivity, the thickness of the thin-film may range between 60–300 A; however, a thickness in the range of 70–180 A, and in particular in the range between 120–150 A has been found desirable.

As used herein, the term "equivalent thickness" is meant that thickness as indicated by a commercial deposition thickness monitor of the quartz crystal type. This thickness may deviate from the actual thickness since there may be areas on an atomic scale that are completely free of material while material may deposit on other areas in thicknesses greater than that indicated by the above calculations.

Upon the formation of the metal layer 24, the second dielectric layer 28 is deposited onto the metal layer 24 in the same manner as that used during the formation of the first layer 26. The dielectric layers 26 and 28 form essentially quarter wavelength interference filters in which the equivalent thickness is effectively equal to one-quarter of the wavelength of visible radition whose transmission is desirably maximized.

In the particularly preferred embodiment, both the dielectric layers 26 and 28 were formed of a thin-film of zinc sulfide having an equivalent thickness of 510 A. The thickness of such dielectric films is preferably maintained between 400 and 600 A. As is well known to those skilled in the art, such dielectric layers may be selected from a large variety of materials. Typically, oxides of titanium, tin and bismuth, sulfides of zinc, cadmium and antimony and cuprous iodide are especially preferred due to the ease in evaporation and relatively low cost. Bismuth oxide may be particularly desired in that it is more stable at elevated temperatures than many dielectric materials. Various of the other dielectric materials may similarly be preferred depending upon the selection of the metals to be used therewith, the wavelength of the radiation to be produced by the phosphor material and conditions under which the resultant electroluminescent device is intended to be utilized. Likewise, different dielectrics of varying thicknesses may be used in each of the layers.

The preform 12 further comprises a conductive film 30 which is deposited along a narrow portion of the transparent electrode 22 and extends substantially along the entire length thereof. The layer 30 is preferably a thin-film of copper having an equivalent thickness of approximately 800 A evaporated onto the top dielectric layer 28 via conventional vapor coating techniques. Such a layer has a surface resistivity somewhat less than one ohm per square. Other conductive films having a resistivity less than one ohm per square may similarly be provided. Similarly, a useful conductive film may be provided via conventional electrochemical deposition processes, sputtering processes and the like.

A final component of the preform 12 consists of an electrically conductive adhesive tape 32. Such a tape is disclosed in U.S. Pat. No. 3,497,383 (Olyphant) and is shown in FIG. 1B to comprise a layer of metal foil 34 and a layer of pressure sensitive adhesive 36. The metal foil is embossed to have a plurality of projections 38 which project a substantial distance through the adhesive 36 to provide electrical contacts through the adhesive onto a surface to which the tape is applied. In the embodiment shown in FIG. 1B, such a surface is that provided by the conductive film 30. The corrugated metal foil 34 thus provides a suitable electrical contact onto which electrical leads may be readily affixed such as by soldering, spotwelding or the like. The tape 34 runs along the length of the conductive film 30 and thereby provides a convenient means by which an electrical potential may be applied, which potential is distributed through the conductive film 30 and substantially uniformly distributed along the transparent electrode 22.

When an electroluminescent lamp is assembled from the preforms 10 and 12 shown in FIGS. 1A and 1B respectively, the outer dielectric layer 28 of the preform 12 is placed in contact with the phosphor layer of the preform 10 and the assembled members are passed between a heated nip roller. Preferably, the roller adjacent the polymeric substrate 20 is steel and is heated to approximately 150° C while the roller adjacent the aluminum base member 14 is rubber and is maintained at room temperature. The pressing causes the aluminum foil and phosphor layer to conform into intimate contact with the outer dielectric layer 28 while being heat fused to the dielectric layer to form an integrated homogeneous construction. Preferably, a layer of electrically insulating tape 40 is first placed on top of the metal tape 32 so as to extend onto the portion of the surface of the outer dielectric layer 28. Thus, when the preforme 10 is pressed onto the surface of the dielectric layer 28, the insulating tape 40 provides a barrier between the conducting tape 32 and the electrode 14, thereby preventing the device from shorting out during use.

In a typical construction wherein a 125 a layer of silver was sandwiched between 510 A layers of zinc sulfide on a polyester base, the transparent electrode 22 exhibited a surface resistivity of approximately five ohms per square, a transmissivity to radiation of 5500 A of approximately 85% and a reflectivity to visible radiation of less than 5%. Such an electrode was bonded to a 65 micrometers layer of copper-doped zinc sulfide luminescent powder in an acrylic binder on a 50 micrometers aluminum foil base electrode together with the contacts as described hereinabove. The resultant lamp was tested and was found to exceed the performance of typical lamps formed by prior art processes.

A lamp such as described in the preforms 10 and 12 of FIGS. 1A and 1B respectively is shown in an assembled view in the cut-away cross section of FIG. 2. In this view it may more clearly be seen that the substrate 20 has coated thereon and extending substantially over the entire surface thereof a transparent electrode 22 comprising the metal layer 24 and dielectric layers 26 and 28 as described in conjunction with FIG. 1B. The conductive film 30 may further be seen to extend substantially along the entire length of one side of the dielectric layer 28. Similarly, the conductive tape 32 having the projections 38 as described hereinabove extends along the length of the conductive film 30. Layer of phosphor particles 16 in a binder 18 on the metal electrode 14 is also there shown to be secured to the dielectric layer 28 and to be insulated from the metal tape 32 via an insulating tape 40 which extends along the length of the device.

The present invention is particularly suited for providing large area electroluminescent devices, such as may extend one or more meters in one direction and typically at least 30 centimeters in the other direction. Such devices are suitable for usse in display applications in which a large area uniform light source is projected through transparent graphic patterns. For example, such displays may be suitable for billboard use as well as for inclusion on large planar surfaces such as the sides of truck and railroad boxcar bodies.

The large area capability provided by the present invention is particularly useful insofar as the preforms are readily provided in continuous vapor coating processes. In such processes large width webs of the polymeric substrate are successively coated with the three layer construction comprising the transparent electrode 22 and with a third layer comprising the conductive film 28, all of which layers extend substantially uniformly along the width of the substrate. After the coatings are formed and the electrically conducting tape 32 applied to the conductive film 30, the preform may then be formed into a roll for shipping and/or storage.

An electroluminescent lamp may further be formed by bonding a similarly large web of aluminum foil having coated thereon a layer of electroluminescent particles in a resinous binder to the preform including the transparent electrode. Such a roll of lamp intermediate may be cut into various sizes depending upon the desired application. In particular, such a selected shape may further be hermetically sealed to minimize degradation due to absorption of water and may preferably include a hygroscopic moisture absorbant material to scavenge such moisture as may remain within the enclosure.

Having thus described the present invention, what is claimed is:

1. A substantially continuous preform adapted to be wound upon itself in roll form for use in forming an electroluminescent device comprising a web of transparent polymeric material, a substantially transparent electrically conducting thin-film layer extending over and secured coextensively to one surface of the web, a continuous electrically conductive metal film in intimate contact with and extending the length of a narrow portion of the thin-film layer, the conductive film exhibiting a surface resistivity not greater than one ohm per square, and electrical contact means adhesively secured to and extending the length of the conductive film such that an electrical potential applied to the contact means is distributed through the conductive film and substantially uniformly distributed throughout the transparent thin-film layer.

2. A preform according to claim 1, wherein the substantially transparent electrically conducting thin-film layer comprises a three layer sandwich of a thin-film of a metal selected from the group including gold, silver and copper between thin-films of dielectric materials generally exhibiting an index of refraction in excess of two, one of the dielectric layers being bonded to the polymeric material, wherein the dielectric layers inhibit light reflection from the metal thin-film and thereby increase the transmissivity thereof.

3. A preform according to claim 2, wherein the metal thin-film layer has an equivalent thickness in the range between 70–180 A and each of the thin-film dielectric layers have an equivalent thickness in the range between 400–600 A to provide asid three layer sandwich exhibiting a resistivity of less than 30 ohms per square and a transmissivity of not less than 70% at a wavelength of 550 micrometers.

4. A preform according to claim 1, wherein the conductive film comprises a metal selected from the group consisting of Cu, Ag and Au deposited onto and in intimate contact with the substantially transparent thin-film layer.

5. A preform according to claim 1, wherein the electrical contact means comprises an electrically conducting adhesive tape including a flexible continuous electrically conductive backing embossed with a plurality of closely spaced projections and a layer of adhesive having a thickness permitting electrical conduction between the projections and a surface to which the tape is applied.

6. In a flexible electroluminescent device comprising a light transmitting flexible resin body having opposing faces and finely divided electroluminescent phosphor particles embedded therein sandwiched between and bonded to electrically conducting electrode layers, one of which electrode layers is substantially transparent, the improvement wherein the substantially transparent electrode layer comprises a transparent polymeric substrate, a substantially transparent electrically conducting thin-film layer extending over and secured coextensively to one surface of the substrate, and a continuous electrically conductive metallic film in intimate contact with and extending the length of a narrow portion of the thin-film layer, the conductive film exhibiting a surface resistivity not greater than one ohm per square, and where the device further includes an electrically conducting means adhesively secured to and extending along said substantial length in an electrically conducting relationship to the conductive film, and a layer of electrically insulating tape adhesively secured between an exposed surface of the electrically conducting means and the surface of the resin body which is elsewhere bonded to the thin-film layer to uniformly distribute an electrical potential applied to the electrically conducting means through the conductiive film and substantially uniformly throughout the transparent thin-film layer, while insulating said potential from the electrode layer on the opposite side of the resin body.

7. A device according to claim 6, wherein the substantially transparent electrically conducting thin-film layer comprises a three layer sandwich of a thin-film of a metal selected from the group including gold, silver and copper between thin-films of dielectric materials generally exhibiting an index of refraction in excess of two, one of the dielectric layers being bonded to the resin body, wherein the dielectric layers inhibit light reflection from the metal thin-film and thereby increase the transmissivity thereof.

8. A device according to claim 7, wherein the metal thin-film layer has an equivalent thickness in the range between 70–180 A and each of thin-film dielectric layers have an equivalent thickness in the range between 400–600 A to provide said three layer sandwich exhibiting a resistivity of less than 30 ohms per square and a transmissivity of not less than 70% at a wavelength of 550 micrometers.

9. A device according to claim 6, wherein the conductive film comprises a metal selected from the group consisting of Cu, Ag and Au deposited onto and in intimate contact with the substantially transparent thin-film layer.

10. A device according to claim 6, wherein the electrical contact means comprises an electrically conducting adhesive tape including a flexible continuous electrically conductive backing embossed with a plurality of closely spaced projections and a layer of adhesive having a thickness permitting electrical conduction between the projections and a surface to which the tape is applied.

11. A device according to claim 6, wherein the device comprises a metallic foil as one electrode layer, onto one surface of which is secured the resin body having embedded therein phosphor particles, the opposite surface of the body being bonded to the transparent electrically conducting thin-film layer and to the layer of electrically insulating tape to separate the resin body and the foil from the metallic tape.

* * * * *